United States Patent [19]

Scott

[11] 4,176,418

[45] Dec. 4, 1979

[54] APPARATUS FOR AUTOMATIC INFLATION OF DIVER FLOTATION MEANS

[76] Inventor: Lawrence S. Scott, 3570 Columbia St., Seal Beach, Calif. 90740

[21] Appl. No.: 851,041

[22] Filed: Nov. 14, 1977

[51] Int. Cl.[2] ..... B63C 9/24

[52] U.S. Cl. ..... 9/313; 9/342

[58] Field of Search ..... 9/313, 341, 311–312, 9/314–328, 336, 342, 329; 137/798–799; 251/142, 149.6, 149.7, 144; 128/142.2, 146.4, 146.5, 142.4

[56] References Cited

U.S. PATENT DOCUMENTS

| | | | |
|---|---|---|---|
| 3,147,499 | 9/1964 | Nelson et al. | 9/313 |
| 3,436,777 | 4/1969 | Greenwood | 9/342 |
| 3,898,705 | 8/1975 | Schuler | 9/313 |

*Primary Examiner*—Douglas C. Butler

*Attorney, Agent, or Firm*—Fulwider, Patton, Rieber, Lee & Utecht

[57] ABSTRACT

Apparatus for automatic inflation of a diver flotation device in response to cessation of breathing by the diver, or in response to pressure reduction of the air source to a predetermined reserve pressure. The apparatus includes high and low pressure systems, the low pressure system being coupled to the diver flotation device and to the diver breathing device. A pair of valves interposed between the high and low pressure systems are responsive to termination of diver breathing and reduction of the source pressure to a predetermined reserve pressure, respectively, to open and allow air from the high pressure system to pass into the low pressure system. This inflates the flotation device and brings the diver to the surface.

8 Claims, 18 Drawing Figures

FIG. 1
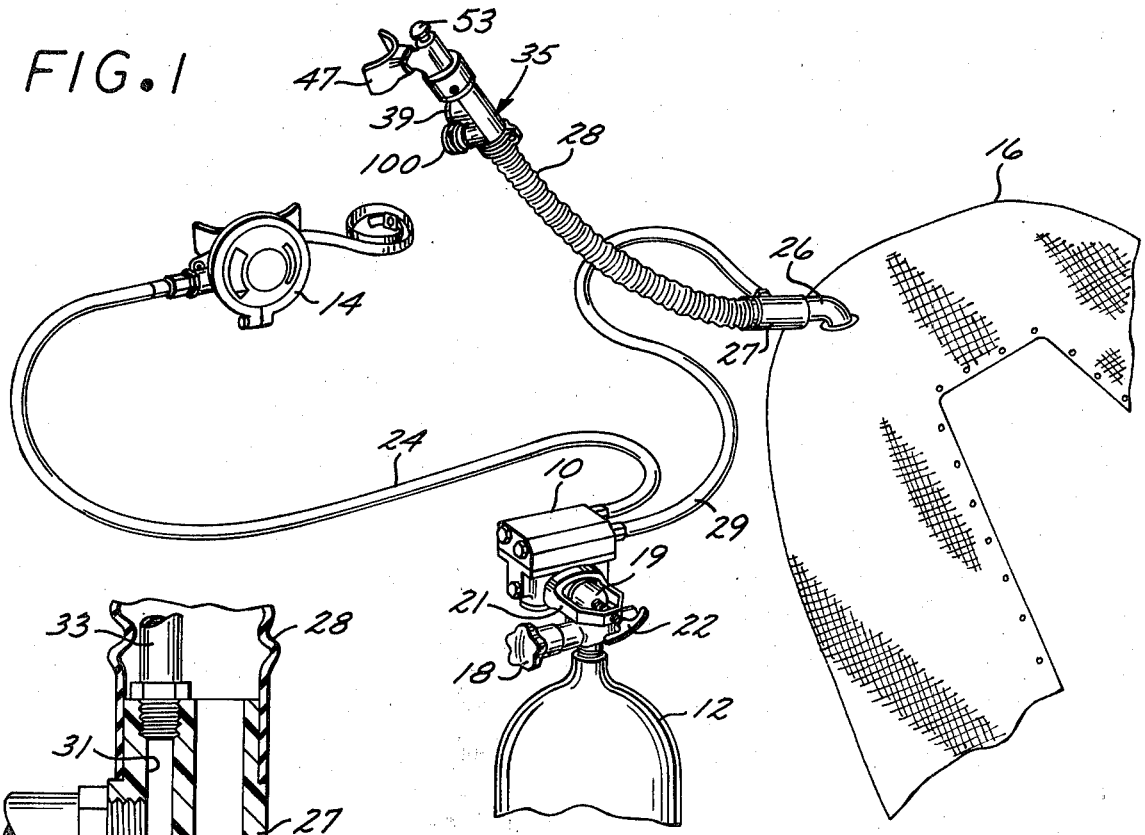
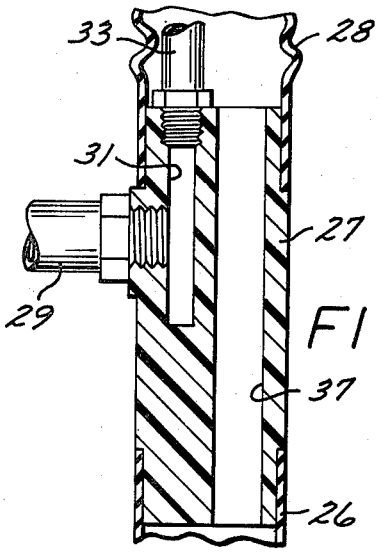
FIG. 18
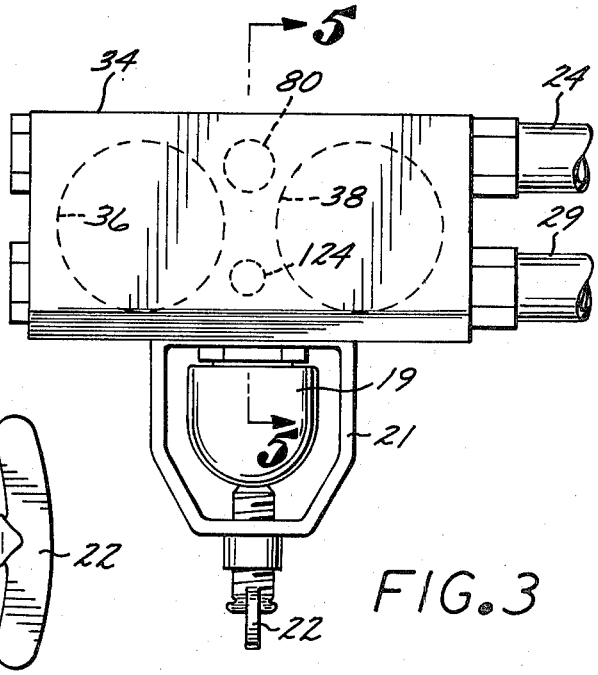
FIG. 3
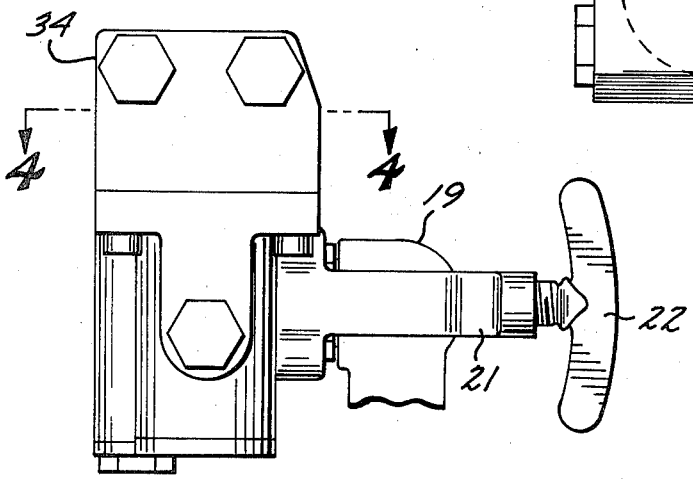
FIG. 2

FIG. 4
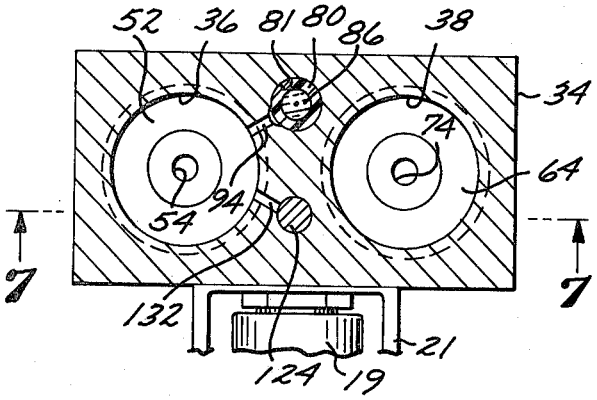
FIG. 5
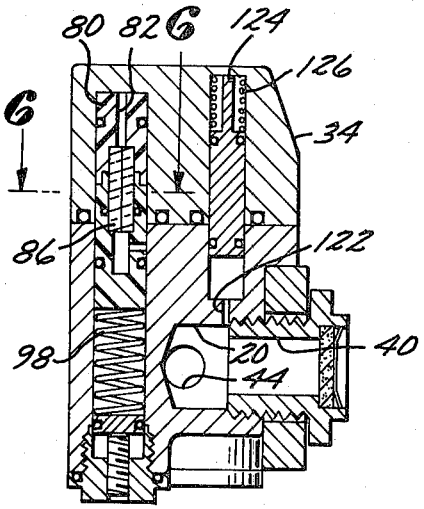
FIG. 7
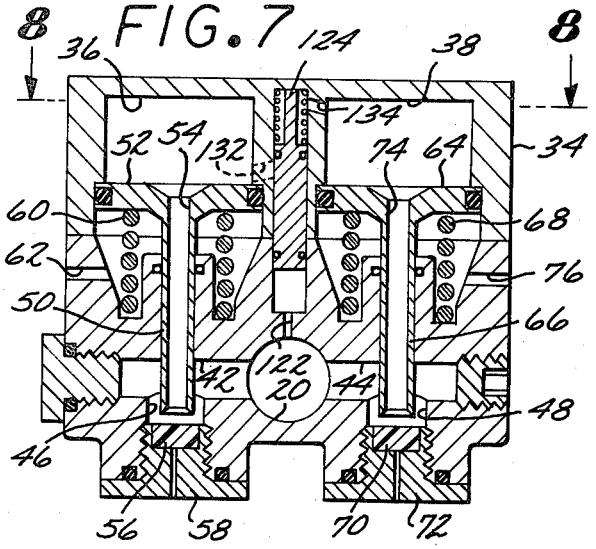
FIG. 9
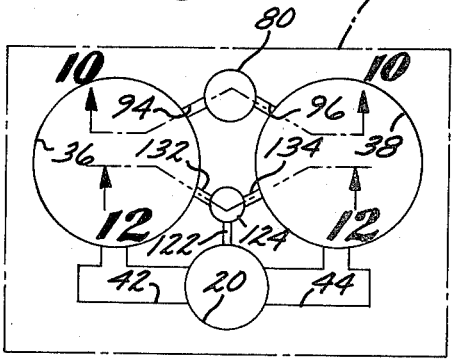
FIG. 8
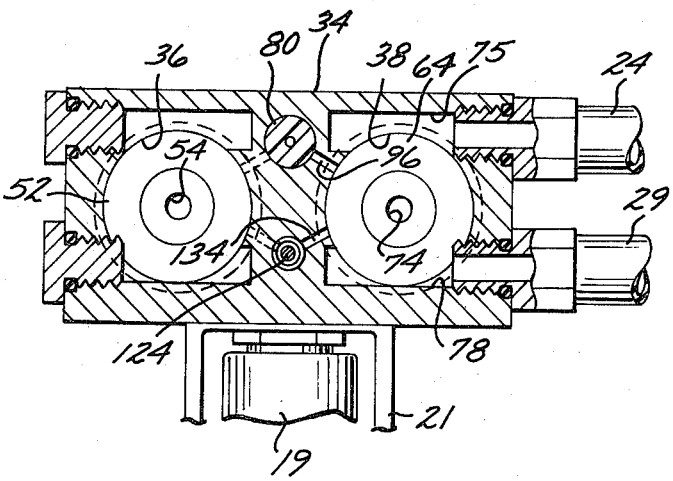
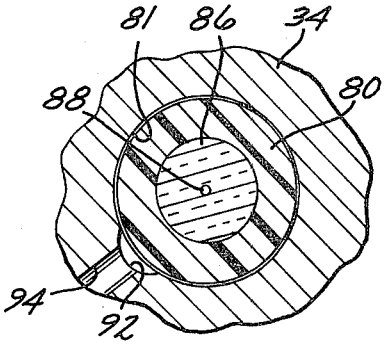
FIG. 6

FIG. 10
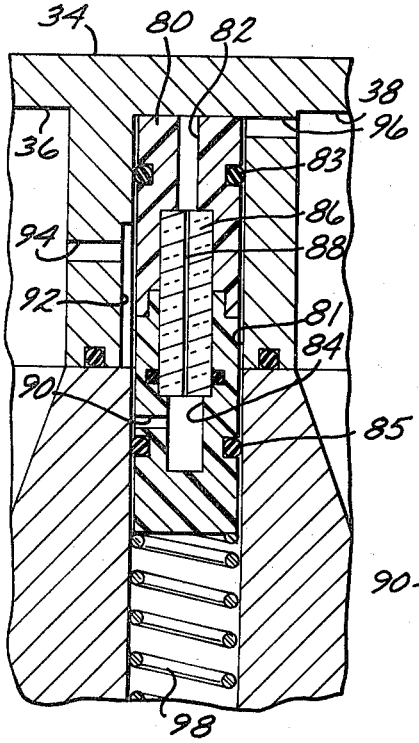
FIG. 11
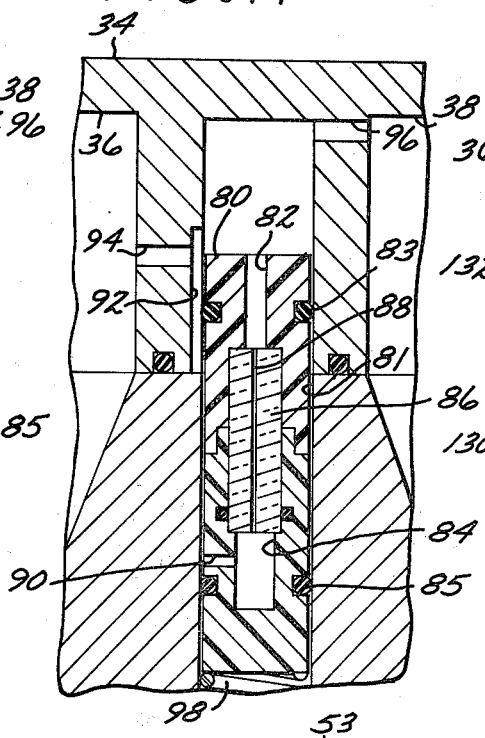
FIG. 12
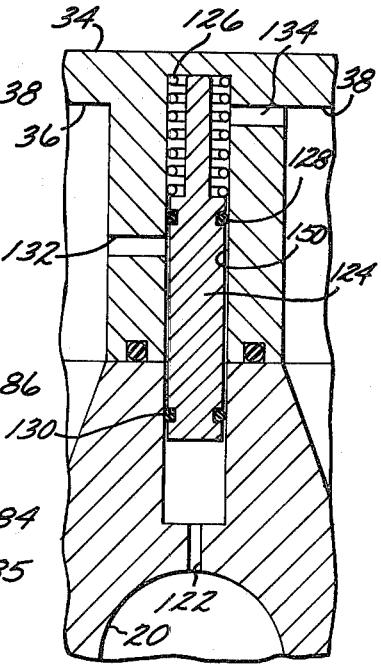
FIG. 13
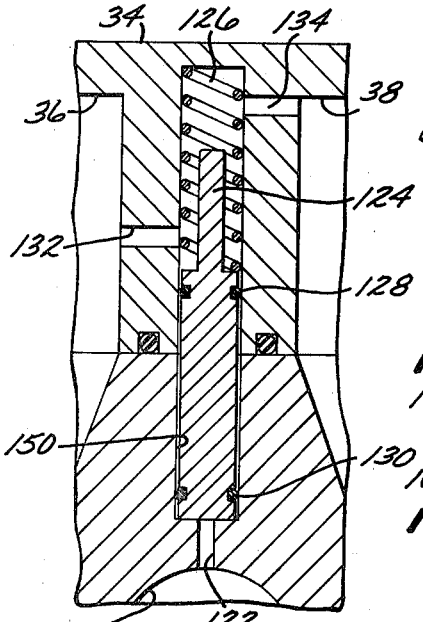
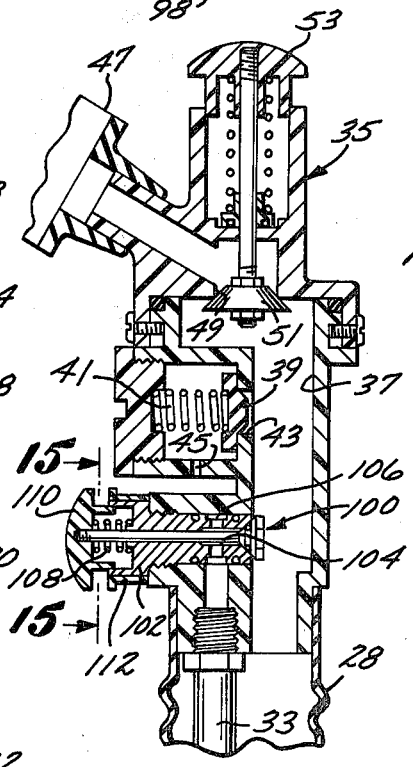
FIG. 14
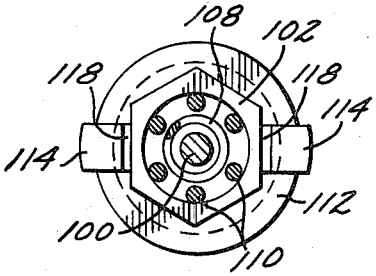
FIG. 15
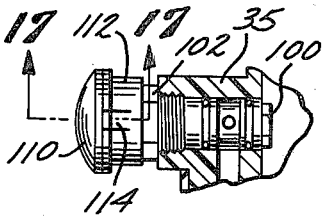
FIG. 16
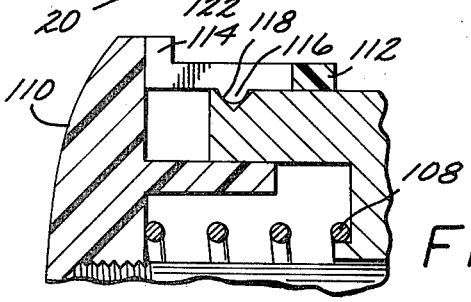
FIG. 17

APPARATUS FOR AUTOMATIC INFLATION OF DIVER FLOTATION MEANS

BACKGROUND OF THE INVENTION

1. Field of the Invention

The present invention relates to apparatus for automatic inflation of river flotation means.

2. Description of the Prior Art

Divers utilizing self-contained underwater breathing apparatus (SCUBA) are able to engage in underwater activity completely independently of persons and equipment on the surface. Consequently, there is no way for anyone to know when a diver is in trouble and has stopped breathing. There is also no way to compel the diver to surface when his air source pressure has dropped to a dangerously low level.

A system for automatically inflating a life jacket when a diver stops breathing is disclosed in U.S. Pat. No. 3,147,499, issued to Nelson et al Sept. 8, 1964. This system is relatively complex, requires a rupturable auxiliary air bottle to accomplish the desired inflation of the life jacket, and subjects the diver to extra breathing effort. In that system the driver's exhalations are utilized to maintain a bellows in an inflated state. The bellows collapse in the absence of such exhalations and trigger the inflation system.

A number of devices are available to apprise the diver of the fact that his available air is at a level sufficiently low that he should surface. One such system generates a sonic warning audible to the diver. Another and very widely used system is the so-called "J-valve," which is nothing more than a valve which restricts the flow of air to the diver when the source pressure has dropped to a particular level. At that time the diver experiences difficulty in breathing and must operate the "J-valve" to be able to breath the "reserve" remaining in his air tank. The "J valve" and most of the other systems are simply warning systems which inform the diver of his diminished air supply. They do not cause the diver to ascent, but merely inform him of the prudence of immediate ascent.

SUMMARY OF THE INVENTION

According to the present invention, an apparatus is provided for automatic inflation of diver flotation means in response to cessation of the diver's breathing. The apparatus is also adapted to inflate the flotation means in response to a drop in source pressure to a predetermined reserve pressure. The apparatus does not merely give a warning but instead causes an automatic, corrective ascent of the diver.

The apparatus includes an override valve manually operable to control or stop the ascent, such as would be important to permit decompression or the like.

The present apparatus does not impose any breathing burden or back pressure since it does not depend upon utilization of the diver's exhalations to operate. Instead, the diver's inhalations are sensed. More particularly, high and low pressure chambers are provided which are coupled to the air source. The low pressure chamber is adapted to supply air to the diver breathing device and to the diver flotation means. However, a valve is employed normally to prevent air passage to the flotation means. A communicating passageway between the high and low pressure systems is normally blocked by a metering valve. This valve constantly meters or bleeds air from the high pressure chamber to a space adjacent the valve to move the valve toward a position which would open communication between the high and low pressure chambers. However, this movement is periodically halted by the successive pressure drops caused in the low pressure chamber by the diver inhalations. If the diver stops breathing, the valve continues to move toward its unblocking position, thereby providing communication between the pressure chambers. When such communication occurs the high pressure air overrides the valve in the flotation means system and inflates the flotation means.

In a generally analogous manner, another valve is used which is responsive to a drop in source pressure to a predetermined level to inflate the flotation means. This valve normally blocks another passageway between the high and low pressure chambers, being maintained in this blocking position by a source pressure at a level above a predetermined reserve pressure. However, when the source pressure drops to the predetermined reserve level, the valve moves to an unblocking position and high pressure air passes to the diver flotation means.

Thus, if a diver loses consciousness or stops breathing for some reason, the present apparatus is automatically operative to bring him to the surface by inflation of the flotation means. No conscious effort is required on the part of the diver to effect ascent. Further, if his air supply drops to a dangerously low level he is automatically caused to ascend without any positive effort on his part. Only a deliberate overriding of the system by the diver will defeat continued ascent.

The present apparatus is reliable, relatively uncomplicated, and easily adapted for use in conjunction with existing diver breathing devices and flotation means.

Other objects and features of the invention will become apparent from consideration of the following description taken in connection with the accompanying drawings.

BRIEF DESCRIPTION OF THE DRAWINGS

FIG. 1 is a perspective view of the present apparatus, attached to a usual diver's compressed air tank and coupled to a diver breathing device and flotation means;

FIG. 2 is a side elevational view of the present apparatus;

FIG. 3 is a top plan view of the apparatus of FIG. 1;

FIG. 4 is a view taken along the line 4—4 of FIG. 2;

FIG. 5 is a view taken along the line 5—5 of FIG. 3;

FIG. 6 is an enlarged view taken along the line 6—6 of FIG. 5;

FIG. 7 is a view taken along the line 7—7 of FIG. 4;

FIG. 8 is a view taken along the line 8—8 of FIG. 7;

FIG. 9 is a generally diagrammatic top plan view analagous to the showing in FIG. 3, but better illustrating the supply of tank pressure to the high and low pressure chambers and the relative location of the reserve valve and the metering valve;

FIG. 10 is an enlarged view taken along the line 10—10 of FIG. 9, and illustrating the metering valve in a closed positon;

FIG. 11 is a view similar to FIG. 10, but illustrating the metering valve in an open position;

FIG. 12 is an enlarged view taken along the line 12—12 of FIG. 9, and illustrating the reserve valve in a closed position;

FIG. 13 is a view similar to FIG. 12, but illustrating the reserve valve in an open position;

FIG. 14 is an enlarged cross-sectional view of the valve assembly which includes the vent valve and the override valve for the flotation means;

FIG. 15 is an enlarged view taken along the line 15—15 of FIG. 14;

FIG. 16 is a view of the override valve of FIG. 14, but in a closed or override position;

FIG. 17 is an enlarged view taken along the line 17—17 of FIG. 16; and

FIG. 18 is an enlarged cross-sectional view of the junction between the air supply line from the present regulator apparatus and the line to the valve assembly illustrated in FIG. 14.

DESCRIPTION OF THE PREFERRED EMBODIMENT

Referring now to the drawings, and particularly to FIG. 2, there is illustrated an automatic inflation apparatus 10 according to the present invention. The apparatus 10 is adapted for connection or coupling to a source of pressurized air, such as a usual and conventional air tank 12, for regulation and delivery of the air at a lower pressure to a diver breathing device or demand regulator 14, and to an inflatable flotation means or bladder 16.

The particular type of air tank 12, demand regulator 14 or bladder 16 used does not form a part of the present invention. These components are well known to those skilled in the art and various types are readily available. A typical air tank 12 designed for use by divers employing self-contained underwater breathing apparatus (SCUBA) includes a shut-off valve 18, and an outlet fitting 19 having an outlet port (not shown) adapted to be coupled in sealing relation to an inlet port 20 of the apparatus 10, as best seen in FIG. 6. The coupling means includes a mounting yoke 21 integral with the apparatus 10 and secureable in position by a wing screw 22 carried by the yoke 21 and operative against the outlet fitting 19. Air in the tank 12 is compressed to a pressure of approximately 2,000 pounds per square inch (psi) and must be reduced for breathing by the diver. For this purpose the apparatus 10 is operative to reduce the tank pressure to a pressure of approximately 125 psi, as will be seen.

The demand regulator 14 is also of conventional construction and, as is well known in the art, is operative to provide air to the diver according to the amount and rate of his inhalations. The demand regulator 14 is provided with air from the apparatus 10 through a connecting hose 24.

An inflatable life jacket, vest, or inflatable bladder are typical forms of diver flotation means utilized to float the diver on the surface, help bring him up from his dive, or assist in establishing neutral buoyancy at some desired depth. The bladder 16 illustrated is of a type which is adapted to be incorporated as an integral part of a diver's back pack. As seen in FIGS. 1 and 18, the bladder 16 is inflated by means of a hose 26 coupled to an airway 28 by a junction fitting 27. More particularly, air is supplied by the apparatus 10 through a hose 29 to a passage 31 terminating at one end in the fitting 27 and coupled at its opposite open end to a flexible conduit 33. The conduit 33 is located internally of the airway or valve assembly 35, at best seen in FIGS. 1 and 14. The air then passes back through the airway 28, through a through passage 37 in the fitting 27, as seen in FIG. 18, and then through the hose 26 to the bladder 16. The assembly 35 is also manually actuable to admit air from the apparatus 10 to the bladder 16 whenever desired, as would be useful in establishing a neutral buoyancy to stabilize the diver at a particular depth.

The valve assembly 35 includes a safety valve 39 which is urged by a compression spring 41 against an outlet port 43 opening to the passage 37 of the assembly 35. The spring rate of the spring 41 is selected such that a predetermined excessive pressure, such as about 3 psi, will open the valve 39 against the bias of the spring 41 and vent the air through the port 43, and through a passage 45 to the outside, thereby preventing the bladder 16 from exploding.

A mouthpiece 47 typically forms a part of the airway 28 and, as best seen in FIG. 18, communicates with the interior passage 37 of the valve assembly 35 through a port 49. The port 49 is normally closed by a valve 51, which can be manually opened by the diver pressing upon a valve knob 53, as will be apparent. With this arrangement the diver can open the port 49 to inflate the bladder 16 with his exhalations through the mouthpiece 47. In addition, opening the port 49 also can be used to vent air from the bladder 16. This allows the diver to adjust his buoyancy and stabilize his dive at a particular depth.

As will be seen, the present apparatus 10 is operative under certain conditions to automatically inflate the bladder 16 with air at 200 psi through the hose 29, the conduit 33, through the valve assembly 35, back through the airway 28, through the junction fitting 27, and through the hose 26. Normally the operating pressure developed by the apparatus 10 in the conduit 33 is approximately 125 psi. An override valve 100 forming a part of the valve assembly 35 normally blocks the flow of air at this pressure to the bladder 16. However, the valve 100 is movable to an open position by air at a pressure of 200 psi so that this air can pass to the bladder 16 and inflate it. Air at 200 psi is supplied by the apparatus 10 only under conditions which will be described hereinafter.

In order to accomplish the functions just described, as best seen in FIGS. 14–17, the valve 100 preferably includes a centrally bored body 102 which is threadedly fitted within a suitable opening formed in a wall of the valve assembly 35 adjacent and in communication with the upper terminus of the conduit 33. The body 102 includes a counterbore 104 in communication, through a plurality of radial passages, with an annular passage 106 which, in turn, communicates with the conduit 33. Passage of air from the conduit 33, into the passage 106 and along the counterbore 104 to the passage 37 is normally blocked by seating of the valve 100 across the end of the counterbore 104.

It is important to note, however, that the bias of the spring 108 is selected such that only a pressure in excess of 125 psi is effective to overcome the bias of the spring 108 and move the valve 100 to its open position. Thus, in the absence of deliberate movement of the button 110 inwardly by the diver, air at 125 psi in the conduit 33 will not pass to the bladder 16. However, air at 200 psi in the conduit 33, as will be seen, is effective to move the valve 100 to an open position, against the bias of the spring 108, to inflate the bladder 16.

The valve 100 is provided with an override feature which permits the diver to lock the valve 100 in seated position so that even air at 200 psi will be ineffective to open the valve 100. This feature would be desirable, for example, where the valve has been opened by air in the conduit 33 at a pressure of 200 psi, the bladder 16 is partially inflated, and the diver has ascended to a depth where he wished to decompress. Shortly before reaching that depth he can operate the valve 100 to close it and maintain it in closed position despite the existence of air at 200 psi in the conduit 33. This is accomplished by a sleeve 112 mounted about and axially slidable over the portion of the valve body 102 located externally of the adjacent wall of the valve assembly 35, as best seen in FIGS. 14–17.

The sleeve 112 is longitudinally slotted to provide a pair of integral, diametrically oppositely located arms 114 each characterized by an inwardly oriented ridge 116. The ridges 116 fit or snap into an annular groove 118 formed in the outer end of the valve body 102. With this arrangement, when the button 110 moves inwardly on opening of the valve 100 by 200 psi air, the diver can pull the sleeve 112 outwardly from the position of FIG. 14 to the position of FIGS. 16 and 17. This moves the valve 100 to its closed position and the constraint caused by the seating of the ridges 116 in the groove 118 is sufficient to prevent the valve 100 from being opened except by means of a relatively strong push by the diver against the button 110. The push has to be strong enough to move the ridges 116 out of the groove 118.

The foregoing air tank 12, demand regulator 14, bladder 16, and valve assembly 35 are components well known in the prior art, and the present apparatus 10, as will be seen, is uniquely adapted to operate with these components. The apparatus 10 is operative to supply air through the hose 24 at a suitable pressure to the breathing device 14, such as approximately 125 psi, and is responsive to a prolonged absence of diver inhalations, or to a reduction in the source pressure of the air tank 12 to a predetermined reserve level, such as approximately 300 psi, to apply air at a pressure of approximately 200 psi to the bladder 16 through the hose 29, the conduit 33, the airway 28, and the hose 26.

With particular reference to FIGS. 3–13, the present apparatus 10 cpmprises, generally, a housing 34 which includes a high pressure cylinder or chamber 36 and a low pressure cylinder or chamber 38. The housing 34 further includes a supply passage 40, FIG. 5, which is coupled to the outlet of the air tank 12 when the apparatus 10 is coupled to the tank 12 by the yoke 21. Air at tank pressure, usually 2000 psi for a fresh tank, passes from the passage 40 to the inlet port 20 and then through branch passages 42 and 44 which connect to a pair of cylindrical regulating chambers 46 and 48 located below the chambers 36 and 38, respectively.

The high pressure chamber 36 and its associated regulating chamber 46 are connected by a bore within which is reciprocable the stem 50 of a piston 52 reciprocable within a larger diameter lower portion of the high pressure chamber 36. Suitable O-rings are provided to effect a sealing relation between the piston 52 and the adjacent walls of the chamber 36, and between the stem 50 and the walls of the adjacent bore.

The stem 50 and piston 52 include a central bore 54 which provides communication between the high pressure chamber 36 and the regulating chamber 46. Such communication is blocked by engagement of the lower end of the stem 50 with a seat 56 forming part of a plug 58 which is threaded into the lower open end of the regulating chamber 46.

The piston 52 is biased upwardly by a compression spring 60 interposed between the underside of the piston 52 and the base of the high pessure chamber 36.

A port 62 is provided which allows ambient pressure to enter the high pressure chamber 36 below the piston 52.

High pressure air from the air tank 12 enters the passage 42 and passes upwardly through the central bore 54. The resulting pressure in the chamber 36 acts upon the relatively large area of the upper face of the piston 52 and urges it downwardly against the bias of the spring 60. The rate of the spring 60 is selected such that when the pressure in the chamber 36 reaches approximately 200 psi, the lower end of the stem 50 seats upon the seat 56 and blocks the passage of any additional air upwardly through the piston bore 54. FIG. 7 illustrates the position of the piston 52 in the absence of any pressure. In normal operation the stem 50 is close to engagement with the seat 56, continually moving toward or away from the seat 56 as the pressure in the chamber 36 rises above or falls below 200 psi.

In similar fashion, the low pressure chamber 38 is provided with a piston 64, stem 66, compression spring 68, seat 70, and plug 72. In the same manner as previously described in connection with the piston 52, air passing from the air tank 12 enters the regulating chamber 48 through the passage 44 and passes upwardly through a central bore 74 provided in the stem 66. The resulting pressure developed in the chamber 38 tends to urge the piston 64 downwardly against the bias of the spring 68. The spring rate of the spring 68 is selected such that when the pressure in the low pressure chamber 38 reaches approximately 125 psi, the lower end of the stem 66 seats against the seat 70 and prevents entry of additional air into the chamber 38 through the piston stem bore 74. In normal operation air is being drawn from the chamber 38 by the demand regulator 14, so that at 125 psi in the chamber 38 the stem 66 does not actually seat against the seat 70. Instead, it is slightly unseated, enough to allow entry of air to replenish that being drawn from the chamber 38 and yet maintain the pressure in the low pressure chamber 38 at the desired 125 psi level.

The housing 34 also includes a port 76 which allows ambient pressure to act against the underside of the low pressure piston 64.

The piston 64 and its associated components constitute a first stage regulator which reduces the source pressure to 125 psi for passage to the demand regulator 14. As will be seen, under certain circumstances air at 200 psi can also be developed in the low pressure chamber 38 for passage to the bladder 16. For these purposes the housing 34, as best seen in FIG. 8, includes a discharge passage 75 opening into the chamber 38 and communicating with the hose 24 extending to the demand regulator 14. The housing 34 also includes an oppositely located discharge passage 78 opening into the chamber 38 and communicating with the hose 29 extending to the bladder junction fitting 27.

The circumstance causing the apparatus 10 to apply 200 psi air to the bladder 16 through the valve assembly 35 is cessation of breathing by the diver. More particularly, the regulator 14 operates on a demand principle so that regular inhalations of the diver cause successive reductions in pressure in the low pressure chamber 38. Regular but separated volumes of air thus pass from the low pressure chamber 38 to the regulator 14. These successive and regular reductions in pressure in the low pressure chamber 38 cause the piston 64 to correspondingly rise off its seat 70 so that air from the tank 12 is utilized to replenish the air taken from the low pressure chamber 38. The present apparatus 10 includes a means for sensing the absence of such successive and regular reductions in pressure in the low pressure chamber 38.

More particularly, as best viewed in FIGS. 4–11, the housing 34 includes a vertically elongated cylindrical bore 81 within which is reciprocally mounted a piston or metering valve 80 characterized by a diameter less than the diameter of the bore 81 to define an annular space with the walls of the bore 81. Usual O-rings 83 and 85 are carried at the upper and lower extremities of the metering valve 80 and provide a fluid-tight fit between the valve 80 and the bore 81.

The valve 80 includes interfitted upper and lower portions having vertically oriented passages 82 and 84, respectively. A central metering element 86 is held between the valve upper and lower portions and is characterized by a calibrated, small diameter orifice 88 which extends the length of the element 86. The orifice 88 provides communication between the passages 82 and 84. It has been found that the element 86 should preferably be made of glass or the like to facilitate formation of the small orifice 88. The orifice 88 is approximately 0.002 inches in diameter and is formed, for example, by drawing a tube having a large diameter passage over a 0.002 inch wire. The heated tube is drawn down to the size of the wire and the wire is thereafter withdrawn.

The upper end of the passage 82 is open to the upper portion of the bore 81, while the passage 84 does not extend through the lower end of the valve 80.

The valve 80 includes a transverse passage 90 extending from the passage 84 and into the annular space around the valve 80 above the O-ring 85.

As best seen in FIG. 6, the wall of the bore 81 adjacent the high pressure chamber 36 includes a vertically elongated passage 92 of arcuate cross section which communicates with the high pressure chamber 36 through a transverse passage 94.

The upper end of the bore 81 communicates with the low pressure chamber 38 through a transverse passage 96.

The metering valve 80 is normally biased or urged upwardly against the upper end of the bore 81, as best seen in FIGS. 5 and 10, by a compression spring 98 interposed between the bottom of the valve 80 and the bottom of the bore 81.

Assuming the diver is not breathing, the low pressure piston 64 will be resting upon its seat 70 and no air will be flowing into the low pressure chamber 38 through the bore 74. At this time air in the high pressure chamber 36 flows through the passages 94, 92, 90, 84, and through the metering orifice 88 into the passage 82. Air metered in this manner into the passage 82 will gradually urge the valve 80 downwardly from the position illustrated in FIG. 10 to that illustrated in FIG. 11. When the O-ring 83 passes below the passage 94, as seen in FIG. 11, there is a sudden rush of high pressure air from the high pressure chamber 36 into the low pressure chamber 38 through the passage 96.

As previously indicated, this air, at approximately 200 psi, passes through the hose 29 and into the conduit 33 to the valve assembly 35. The air pressure is sufficient to overcome the spring 108 and unseat valve 100, allowing high pressure air to pass to the bladder 16, inflating it, and floating the diver toward the surface. Any excessive air in the bladder 16 is vented through the safety valve 39.

The foregoing operation assumed the diver was not breathing normally. Normally the breathing of the diver maintains the metering valve 80 in the position illustrated in FIG. 10. That is, each time the diver inhales, the resulting partial evacuation of the low pressure chamber 38 reduces the pressure in chamber 38, causing the piston 64 to rise off its seat sufficiently to allow additional air to flow into the chamber 38. The repetitive establishment of a low pressure condition in the chamber 38 caused by the diver's inhalations also establishes a corresponding low pressure condition at the upper end of the metering valve bore 81. This maintains the metering valve 80 in the position illustrated in FIG. 10 because the air bleeding or metered through the orifice 88 is regularly drawn into the chamber 38 through the passage 96.

In the event the diver has his diving gear in the water, but is not using the breathing apparatus, he can override the present apparatus 10 to prevent inflation of the bladder 16 in the manner just described. This is done by pulling the sleeve 112 outwardly, as seen in FIG. 14, thereby preventing unseating of the valve 100. Thereafter, when the diver wishes to reactivate the apparatus 10, he merely presses in the valve button 110, and the bladder 16 will then be inflated in the absence of diver inhalations.

It is noted that the amount of air drawn out of the low pressure chamber 38 when the diver is breathing is much greater than the amount of air flow that is possible through the passage 96. Consequently, the valve 80 immediately rises and is reset to the position of FIG. 10 as soon as the diver begins to breathe. As will be apparent, the spring rate of the spring 98 and the size of the orifice 88 is carefully selected and adjusted to achieve the foregoing results, as will be apparent to those skilled in the art.

There is another circumstance which will cause the apparatus 10 to automatically inflate the bladder 16. With particular reference to FIGS. 5, 12, and 13, the housing 34 includes a vertically elongated, cylindrical bore 150 in communication with the inlet port 20 through a vertical passage 122. A reserve piston or valve 124 is vertically reciprocable within the bore 150 and is characterized by a reduced diameter upper portion about which is disposed a compression spring 126 which tends to urge the reserve valve 124 from the position illustrated in FIG. 12 to the position illustrated in FIG. 13.

The upper and lower extremities of the lower portion of the reserve valve 124 carry O-rings 128 and 130, respectively, to provide a sealing relation between the bore 150 and the valve 124. The larger diameter lower portion of the valve 124 is of lesser diameter than the bore 150 to define an annular space between the O-rings 128 and 130. This space is in communication with the high pressure chamber 36 through a transverse passage 132.

The upper end of the bore 150 is in communication with the low pressure chamber 38 through a transverse passage 134.

Depending upon the reserve pressure desired, which typically would be approximately 300 psi, a spring 126 is selected having a spring rate such that the spring 126 is ineffective to move the reserve valve 124 from the position illustrated in FIG. 12 to the position illustrated in FIG. 13 until such time as the source or tank pressure in the inlet port 20 drops to 300 psi. When such a drop occurs the reserve valve 124 moves to the position of FIG. 13. High pressure air then passes from the chamber 36, through the passage 132, into the bore 150, through the passage 134, into the low pressure chamber 38, and through the hose 29 to the conduit 33. The high pressure air unseats the valve 100, and flows back through the airway 28 and into the bladder 16. The resulting bladder inflation brings the diver toward the surface. Again, if the diver wishes to override this automatic inflation of the bladder 16, as might be the case should he desire to decompress at a particular level, he pulls upon the sleeve 112 of the override valve 100 to outwardly pull the valve button 110. This seats the valve 100 and holds it in this seated position.

From the foregoing it is seen that the present apparatus is effective to automatically bring the diver to the surface whenever his tank pressure drops below a predetermined reserve level, or whenever his breathing drops below a normal rate. However, override means are provided so that the diver can terminate such automatic inflation of his flotation means whenever he desires.

Various modifications and changes may be made with respect to the foregoing detailed description without departing from the spirit of the invention.

I claim:

1. Apparatus for automatic inflation of diver flotation means, said apparatus comprising:

a source of air under pressure;

inflatable flotation means; and control means connecting said source and said flotation means, including regulator means operative to convert the air pressure of said source to a lower first pressure, and further including valve means automatically operative to apply said first pressure to said flotation means in response to reduction of the air pressure of said source to a predetermined reserve pressure.

2. Apparatus for automatic inflation of diver flotation means from a source of air under pressure, upon reduction of said pressure to a predetermined reserve pressure, said apparatus comprising:

regulator means adapted to be coupled to said source of air and operative to reduce the pressure of said source to a first pressure;

a reserve valve movable between an open position for passing air from said regulator means to said flotation means, and a closed position for blocking the passage of air from said regulator means to said flotation means;

means for applying air from said source of air under pressure to said valve to develop a force for moving said valve toward said closed position; and bias means urging said valve toward said open position in opposition to said force, the bias of said bias means being selected to exceed said force when the pressure of said source falls below a predetermined reserve pressure.

3. Apparatus for automatic inflation of diver flotation means from a source of air under pressure, said apparatus comprising:

defining means defining first and second chambers adapted for connection in communication with said source and including pressure regulating means operative to establish a first pressure in said first chamber and a second pressure in said second chamber, said first pressure being higher than said second pressure and lower than said source pressure, said second chamber being adapted for connection in communication with said flotation means, said defining means further defining a first communicating passageway between said first and second chambers;

first valve means adapted to be interposed between said flotation means and said second chamber for normally closing said communication therebetween, said first valve means being automatically operable to open said communication upon subjection of said first valve means to a pressure approximating said first pressure; and reserve valve means coupled to said source and responsive to a source pressure in excess of a predetermined reserve pressure to block said first communicating passageway, said reserve valve means being responsive to a source pressure below said predetermined reserve pressure to open said first communicating passageway whereby said higher first pressure is developed in said second chamber for application to said first valve means to open communication to and thereby automatically inflate said flotation means.

4. Apparatus according to claim 3 wherein first valve means includes a manually operative override valve to close said communication between said flotation means and said second chamber.

5. Apparatus according to claim 3 and including a diver breathing device in communication with said second chamber; and metering valve means having a closed position normally blocking a second communicating passageway between said first and second chambers, said metering valve means including a metering passage normally in communication with said first chamber to meter air from said first chamber to a metering space adjacent said second chamber, said metering valve means being movable toward said closed position in response to reductions in pressure in said metering space, said metering valve means being movable toward an open position in response to increases in pressure in said metering space to open said second communicating passageway and thereby automatically inflate said flotation means.

6. Apparatus for automatic inflation of diver flotation means from a source of air under pressure upon cessation of diver inhalations through a diver breathing device, said apparatus comprising:

means defining first and second chambers adapted to be connected in communication with said source and including pressure regulating means operative to establish a first pressure in said first chamber and a second pressure in said second chamber, said first pressure being higher than said second pressure and lower than said source pressure, said means further defining a first communicating passageway between said first and second chambers, said second chamber being adapted for communication with said diver breathing device and said flotation means;

valve means interposed between said flotation means and said second chamber and normally closing said communication therebetween, said valve means being automatically movable to open said communication upon subjection of said valve means to a pressure approximating said first pressure; and a metering valve responsive to a predetermined low pressure in said second chamber to normally block said first communicating passageway, said metering valve including means defining a second communicating passageway between said first and second chamber to meter air into said second chamber, said metering valve being responsive to a predetermined high pressure developed in said second chamber in the absence of pressure reductions from diver inhalations to open said first communicating passageway whereby said higher first pressure is developed in said second chamber for application to said valve means to open communication to and thereby automatically inflate said flotation means.

7. Apparatus according to claim 6 wherein said valve means includes a manually operative override valve to open and close said communication whenever desired.

8. Apparatus according to claim 6 wherein said first mentioned means further defines a metering space between said second chamber and said second communicating passageway; and wherein said second communicating passageway is defined by a relatively small metering passage in communication with said first chamber to meter air to said metering space.

* * * * *